United States Patent [19]

Nilsen et al.

[11] 4,149,349

[45] Apr. 17, 1979

[54] WALL FORMING ASSEMBLY

[75] Inventors: Knut E. Nilsen, Monrovia; Homer C. Shirley, El Monte, both of Calif.

[73] Assignee: Arcadia Enterprises Corp., Arcadia, Calif.

[21] Appl. No.: 300,106

[22] Filed: Oct. 24, 1972

Related U.S. Application Data

[63] Continuation-in-part of Ser. No. 196,643, Nov. 8, 1971, abandoned.

[51] Int. Cl.[2] ..... E04B 1/16

[52] U.S. Cl. ..... 52/381; 52/410; 52/444; 52/564; 52/712

[58] Field of Search ..... 52/383, 353, 426, 379–381, 52/281, 282, 288, 715, 561–571, 357, 243, 410, 444, 712; 287/20.92 R, 20.92 C, 20.92 D

[56] References Cited

U.S. PATENT DOCUMENTS

| | | | |
|---|---|---|---|
| 759,728 | 5/1904 | Maxwell | 287/20.92 C |
| 1,427,372 | 8/1922 | Geraerdts | 52/715 |
| 1,483,042 | 2/1924 | Coombs | 52/426 |
| 1,488,726 | 4/1924 | Alexander et al. | 52/379 |
| 1,575,931 | 3/1926 | Orlopp | 52/715 |
| 1,917,365 | 7/1933 | Goertz et al. | 52/282 |
| 2,017,973 | 10/1935 | Jenkins | 52/383 |
| 2,091,542 | 8/1937 | Frati | 52/388 |
| 2,173,094 | 9/1939 | Burson | 52/353 |
| 2,919,572 | 1/1960 | Salzi | 52/381 |
| 3,347,609 | 10/1967 | Mann | 312/257 R |
| 3,676,967 | 7/1972 | Frati | 52/426 |

FOREIGN PATENT DOCUMENTS

| | | | |
|---|---|---|---|
| 921852 | 3/1963 | United Kingdom | 52/281 |

*Primary Examiner*—James L. Ridgill, Jr.
*Attorney, Agent, or Firm*—Huebner & Worrel

[57] ABSTRACT

A prefabricated consumable assembly for forming a concrete wall structure includes a pair of spaced apart side plates interconnected on their ends by transverse tie members. A single or a pair of insulating panels is positioned within the side plates and structure is associated with each tie member which defines grooves for receiving and holding the side edges of the insulating panel or panels. The groove defining structure may be formed by a detachable clip mounted on the tie members or entirely or in part integral with the tie members. Mechanism is provided for interlocking assembled ones of the prefabricated assemblies to form a wall structure including an inside corner. The side plates may be arranged for bending to form corners.

6 Claims, 19 Drawing Figures

10
11
12
13
14
15
16
17
18
19
30
32
40
41
50
52
53
54
55
72

30
31
31a 10
11
12
13
14
18
19
20
30
31
32
40
41
50
53
54
57
72

11
12
15
30
31
32

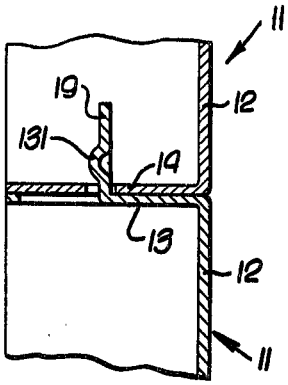
FIG. 17.
FIG. 18.
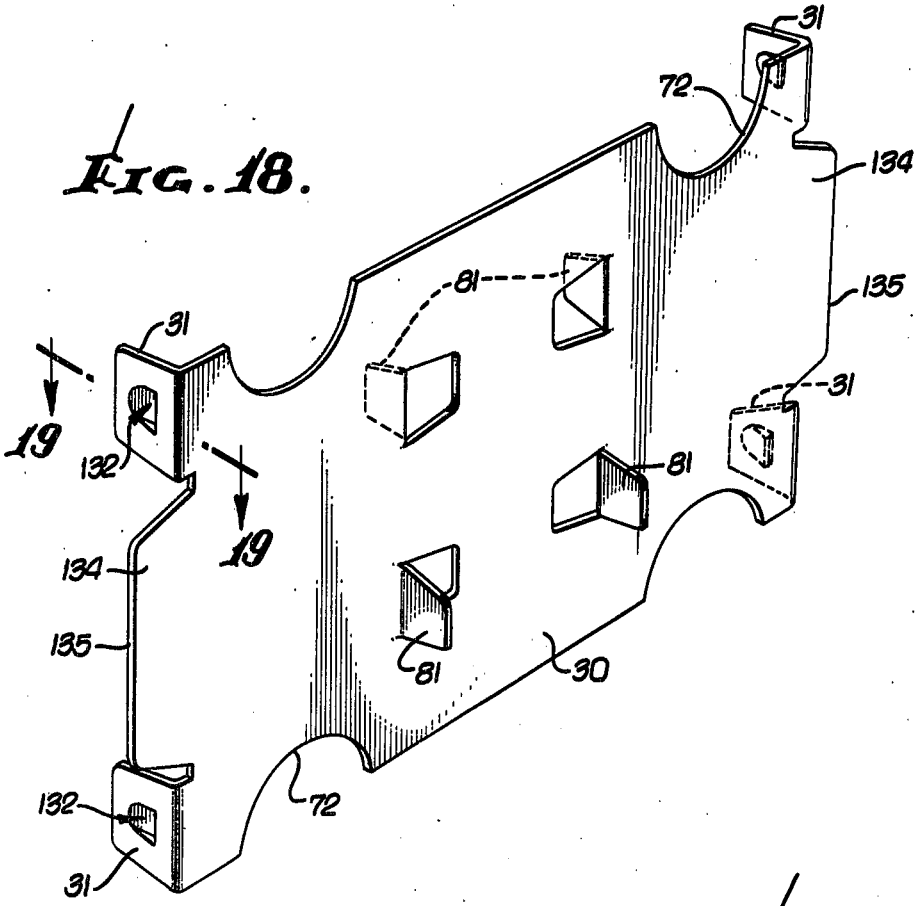
FIG. 19.
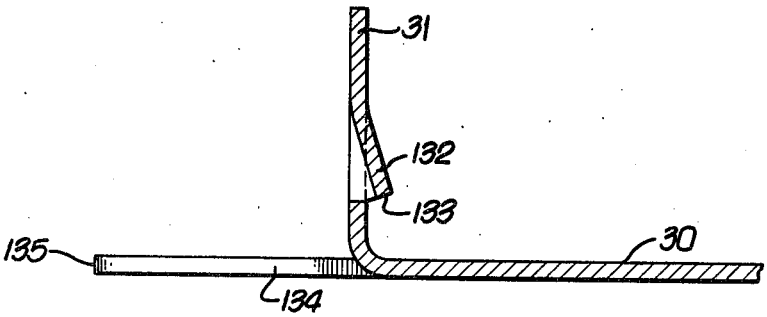

WALL FORMING ASSEMBLY

CROSS REFERENCE TO RELATED APPLICATION

This is a continuation-in-part of application Ser. No. 196,643, filed Nov. 8, 1971, which was abandoned in favor of this continuation-in-part.

BACKGROUND OF THE INVENTION

The present invention relates to the construction of walls and more particualarly to an improved wall forming assembly suitable for use in constructing concrete wall structures.

Assemblies for constructing concrete wall structures have heretofore been provided. An example of such an assembly is illustrated in U.S. Pat. No. 2,919,572 issued to V. H. Salzi.

In the assembly disclosed in the Salzi patent, concrete is poured between outside side plates and inner insulating panels to form the concrete wall structure and the insulating panels are held spaced apart by spacing strips in order to provide a dead air space in the formed wall. A significant disadvantage with the Salzi assembly is that panels and spacing strips need to be tacked together prior to being placed in the assembly in order to avoid movement of the insulating panels during the pouring of the concrete. This step of assembling the insulating panels with the spacing strips along with the need for furnishing properly dimensioned spacing strips constitutes a waste of time and material. Further, the Salzi assembly is designed for holding pairs of insulating panels. The use of pairs of insulating panels in wall construction, however, in many cases is not necessary or desirable and generally is too costly. Also, it is noted that certain insulating materials, such as styrofoam, do not have sufficient structural strength for mounting in pairs in a spaced apart manner and need to be mounted as a single panel. Therefore, the need exists for a wall forming assembly useable with single insulating panels.

SUMMARY OF THE INVENTION

It is accordingly an object of the present invention to provide an improved consumable assembly for forming a wall structure, such as a concrete wall structure, which is characterized by forming a structural part of the wall structure which it is used to construct.

It is further an object of the present invention to provide an improved wall forming assembly which includes an improved arrangement for holding a pair of insulating panels spaced apart between a pair of side plates.

It is another object of the present invention to provide an improved spacing clip for attachment to the transverse tie member of a wall forming assembly which clip defines groove structure for receiving and holding the side edges of a pair of insulating panels substantially parallel to each other.

It is also an object of the present invention to provide an improved wall forming assembly which includes an improved arrangement for holding single insulating panels.

It is additionally an object of the present invention to provide an improved wall forming assembly which includes improved mechanism for interlocking the assembly in an assembled state and also for interlocking it with adjacent assemblies.

It is still another object of the present invention to provide an improved clip for holding vertically and horizontally adjacent wall forming assemblies together to form an inside wall corner.

It is yet another object of the present invention to provide an improved side plate for a wall forming assembly which is arranged for bending to form a corner.

In accomplishing these and other objects, there is provided in accordance with the present invention a prefabricated consumable assembly for forming a concrete wall structure which includes a pair of spaced apart side plates interconnected on their ends by tie members. A pair of insulating panels may be included for forming a dead air space in the wall structure and structure is then associated with the tie members for defining spaced apart grooves for receiving and holding the side edges of the insulating panels spaced apart between the side plates. Alternately single insulating panels may be mounted between the side plates. Structure is then associated with the tie members for defining grooves facing in diametrically opposite directions for holding the side edges of adjacent single insulating panels. The groove defining structures may be formed by detachable clips mounted on the tie members, by structure entirely integral with the tie members or by the combination of clips and structure integral with the tie members. To form a wall structure by use of the assemblies, several assemblies are interlocked by mechanism provided thereon, insulating panels are positioned in the groove defining structure and concrete or the like is poured between the outside side plates and the inner insulating panel or panels. A clip mechanism is also provided for holding vertically and horizontally adjacent wall forming assemblies together to form an inside wall corner and another embodiment of side plate for the wall forming assembly is provided which is arranged for bending to form a corner.

Additional objects of the present invention reside in the specific construction of the embodiments of wall forming assembly hereinafter particularly described in the specification and shown in the several drawings.

BRIEF DESCRIPTION OF THE DRAWINGS

FIG. 17 is a view taken like in FIG. 15 of yet another suitable lug-slot arrangement for interlocking vertically adjacent side plates.

FIG. 18 is a perspective view of still another transverse tie member having lugs with louver-like locking mechanism formed thereon.

FIG. 19 is a view taken along line 19—19 of FIG. 18.

DETAILED DESCRIPTION OF THE PREFERRED EMBODIMENTS

Figure 1:
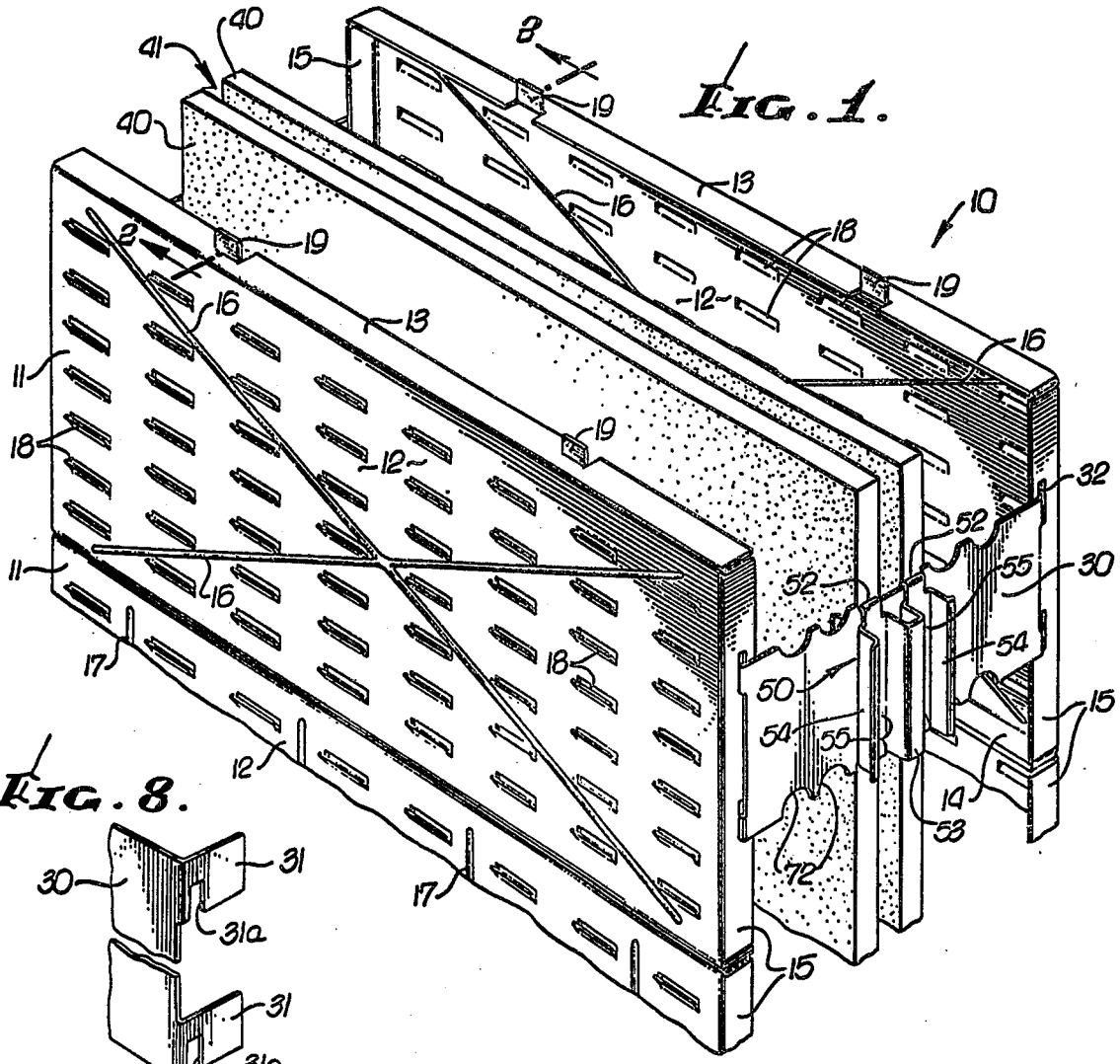
FIG. 1 is a perspective view of a wall forming assembly according to the present invention illustrated vertically interlocked with a second such assembly.

Referring to the drawings in more detail, there is shown in FIG. 1 a wall forming assembly generally identified by the numeral 10 joined with a second similar wall forming assembly. The assembly 10 includes a pair of outer side plates 11 having a planar body portion 12 surrounded by a peripheral edge made up of top and bottom flanges 13 and 14 and end flanges 15. The entire side plate 11 may be formed from a single piece of metal, for example by stamping, with the flanges 13, 14 and 15 making up the edge portion being formed by bending the borders of the planar body 12 into planes perpendicular to the major planar surface. It is noted that materials other than metals could be used for forming the side plates; for example, a suitable plastic could be molded to form the side plates 11.

The planar portions 12 of the side plates 11 may be reinforced by forming brace structure thereon. If the plates 11 are metal, the brace structure may be formed by stamping the side plates. In FIG. 1, the uppermost side plates 11 have diagonal bracing ribs 16 stamped therein while the lowermost plates 11 have vertically extending bracing ribs or ridges 17 stamped therein.

The side plates 11 shown in FIG. 1 have outwardly projecting louvered slot arrangements 18 formed therein, selected ones of which are identified, in order to provide projections upon which finishing materials, such as plaster, stucco, cement or the like, may be anchored. It is noted that if it were desired to bake enamel, afix paneling or apply a plastic coating to the outside of the planar surfaces 12 of the side plates 11 that the surfaces 12 could be left smooth with no slots 18 formed therein.

Figure 2:
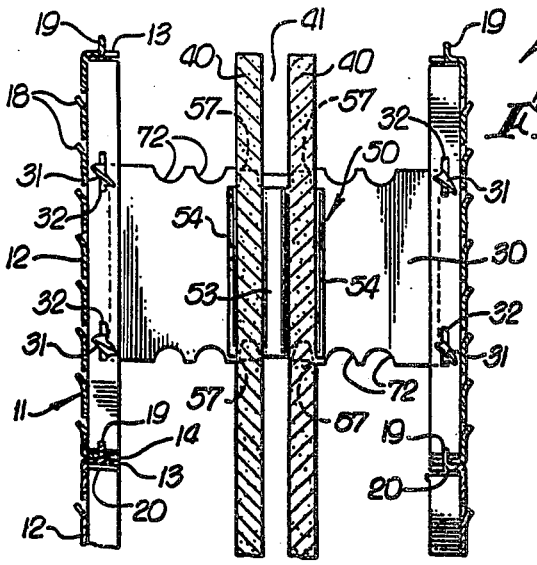
FIG. 2 is a sectional view taken along the line 2—2 of FIG. 1.

As shown in FIG. 2, vertically extending lugs 19 are formed on the upper side plate flange 13 and complementary slots 20 of predetermined width are provided in the lower flange 14 for receiving the lugs 19. Thereby, the plate members 11 may be stacked one upon another to any desired height with the plates 11 being locked against lateral displacement by the lug and slot arrangments. The lugs 19 may be conveniently formed by cutting and bending outward a portion of the flanges 13, but may be formed in other suitable ways. Further, the lugs 19 once inserted in the slots 20 could be bent or twisted to firmly join the interconnected side plates 11.

Figure 8:
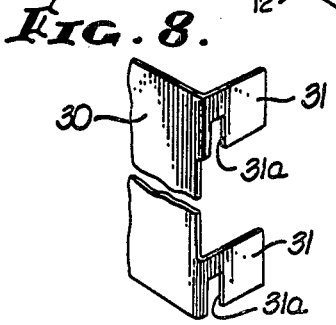
FIG. 8 is a perspective view of an alternate form of lug for connecting the transverse tie members to the side plates of the wall forming assembly.

The wall forming assembly 10 includes tie members or means 30 for clamping the side plates 11 in a spaced apart substantially parallel relationship with respect to each other. The tie members 30 are each preferably transverse extending rigid plate-like members which have lugs 31 formed on their four corners. Locking slots 32 for receiving the lugs 31 are formed in the side plate ends 15 and the lugs 31 are bent or twisted, as shown in FIG. 2, to connect the transverse tie members 30 to the plates 11. Alternately, slots 31*a* could be formed in the lugs 31, as shown in FIG. 8, for connecting the transverse tie members 30 to the plates 11. The slots 31*a* are adapted for interlocking with the locking slots 32, thereby to engage the side plate ends 15.

Figure 3:
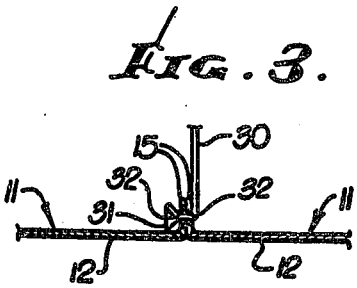
FIG. 3 is a partial top sectional view illustrating the side plates of two assemblies of the type shown in FIG. 1 horizontally interlocked by a lug on a transverse tie member.

As shown in FIG. 1, the tie members 30 function to interconnect both ends of the side plates 11 and hold them in a spaced apart substantially parallel relationship. Further, the tie members 30 are used to interlock the plate members 11 forming the horizontal course or extension of the wall structure. As shown in FIG. 3, the lugs 31 are inserted through the locking slots 32 of two longitudinally adjacent side plates 11 which have their end flanges 15 positioned against each other with their slots 32 aligned. Thereby, a plurality of assemblies 10 may be interconnected longitudinally to form a wall structure of any desired length.

The wall forming assembly 10 also includes insulating panels 40 made of any suitable insulation material. The panels 40 are dimensioned for placement between the side plates 11 to extend from the tie member 30 located at one end of a side plate 11 to the tie member 30 at its opposite end. As shown in FIGS. 1 and 2, each insulating panel 40 may be formed of one piece having a width substantially equal to the length of the side plates 11 and having a height equal to the height of the wall structure formed by the vertically interconnected assemblies 10.

Figure 4:
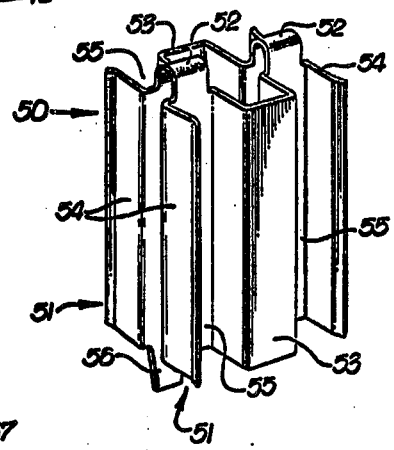
FIG. 4 is a perspective view of one embodiment of structural arrangement for holding the side edges of a pair of insulating panels spaced apart.

One structural embodiment of spacing means for receiving and holding the side edges of a pair of the insulating panels 40 in a spaced apart relationship so as to define a dead air space 41 therebetween is shown in FIGS. 1, 2 and 4. This holding arrangement is in the form of a spacing clip generally designated by the numeral 50. The clip 50 includes two similar portions 51 which are interconnected at their upper ends by U-shaped connections 52. Each of the clip portions 51 are constructed with flat backs for fitting against the tie members 30 and have a central rectangular portion 53 positioned between side extensions 54. The central portion 53 cooperates with the side extensions 54 to define a pair of parallel spaced apart uniform grooves 55. The grooves 55 are defined by the clip portions 51 to have a uniform width approximately equal to the thickness of the insulating panels 40.

The spacing clip 50 is detachably secured on a tie member 30 by being hung thereon with the U-connections 52 resting on the upper edge of the tie member 30 and the clip portions 51 depending downward on each side thereof. Tabs 56 are formed on the lower end of one clip portion 51 for bending under the tie member 30 against the lower portion of the other clip portion 51, thereby to clamp the clip 50 in place as shown in FIG. 1. The clip 50 when clamped on a tie member 30 is held by guide structure in a central position thereon with the parallel grooves 55 aligned parallel to the side plates 11. This guide structure which aligns the spacing clip is provided by the extensions 57 on the tie member and the U-connections 52 and tabs 56 on the spacing clip, the U-connections 52 and tabs 56 being dimensioned to fit between and against the extensions 57.

Figure 5:
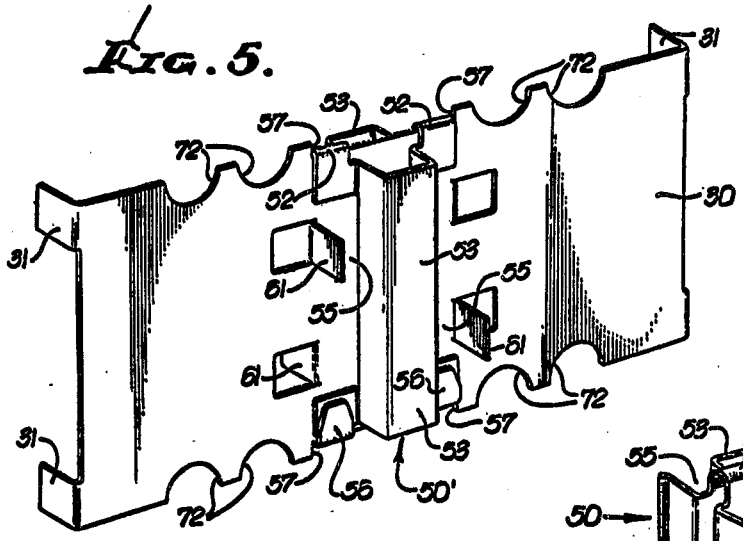
FIG. 5 is a perspective view of a transverse tie member having formed thereon another embodiment of structural arrangement for holding the side edges of a pair of insulating panels spaced apart.

Another structural embodiment for receiving and holding the side edges of a pair of insulating panels 40 in a spaced apart arrangement is shown in FIG. 5. This holding arrangement is shown mounted on a tie member 30 and is formed by a detachable spacing clip 50' and four extensions 61 formed integral with the tie member 30. The clip 50' is a modified form of spacing clip 50 from which the side extensions 54 have been eliminated. The extensions 61 on the tie member 30 extend substantially perpendicular to tie member 30 parallel with the sides of the rectangular clip portions 53. One extension 61 is associated with each side of the rectangular clip portions 53. Thereby, the extensions 61 and the sides of the clip portions 53 define a pair of the parallel grooves 55 on each side of the tie member 30 for gripping the side edges of insulating panels 40. The extensions 61 may be conveniently formed by cutting and bending portions of the tie members 30 perpendicular to their planar surface.

Figure 6:
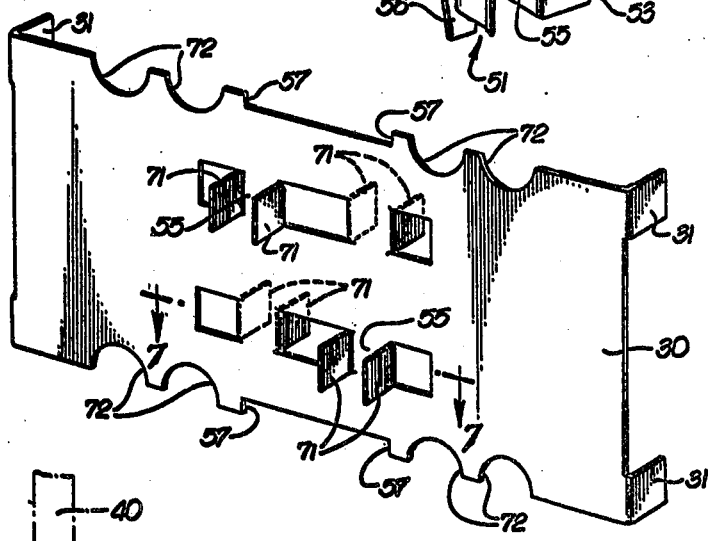
FIG. 6 is a perspective view of another transverse tie member having formed thereon still another embodiment of structural arrangement for holding the side edges of a pair of insulating panels spaced apart.
Figure 7:
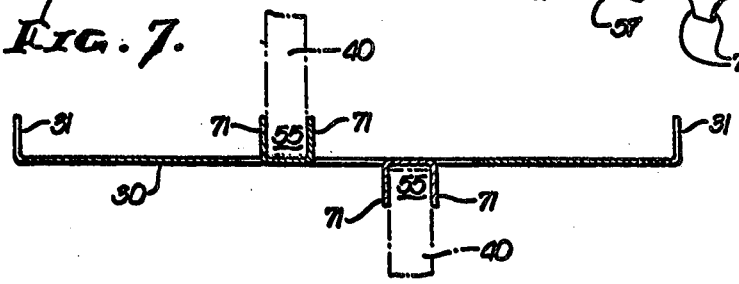
FIG. 7 is a sectional view taken along the line 7—7 of FIG. 6.

Yet another structural embodiment for defining the parallel grooves 55 is shown in FIGS. 6 and 7. In this structural embodiment, the grooves 55 are defined by pairs of spaced apart mutually parallel extensions 71 which are preferably integral parts of the tie member 30. The pairs of extensions 71 extend substantially perpendicular to the tie member 30 and may be conveniently formed by cutting and bending portions of the tie member 30 perpendicular to its planar surface. Insulating panels 40 are shown in phantom lines in FIG. 7 held by the extensions 71 in a substantially vertical plane.

In order to construct a wall structure in accordance with the present invention, a plurality of assemblies 10 employing any one of the embodiments for defining the grooves 55 are interlocked both longitudinally and vertically to construct a sketetal wall structure. The side edges of the insulating panels 40 are then inserted in the grooves 55 so as to be held spaced apart parallel to the side plates 11, the dead space 41 being formed between the panels 40. It is noted that this dead space 40 adds materially to the insulation and structural aspects of the finished wall structure. Concrete is next poured between the insulating panels 40 and their adjacent side plates 11 to form a concrete wall. As before-described, an appropriate finishing surface may be formed on or applied to the exterior surfaces of the side plates 11 to provide an attractive wall structure.

It is noted that cutouts 72, selected ones of which are identified, are formed in the upper and lower edges of the tie members 30. Each cutout 72 is preferably laterally positioned between a side plate 11 and an insulating panel 40. These cutouts 72 are for holding and supporting concrete reinforcing rods, electrical conduits and the like which are incorporated into the wall structure. The reinforcing rods and conduits would be longitudinally positioned between the side plates 11 and panels 40 to rest in the cutouts 72 prior to pouring the concrete therebetween.

Figure 9:
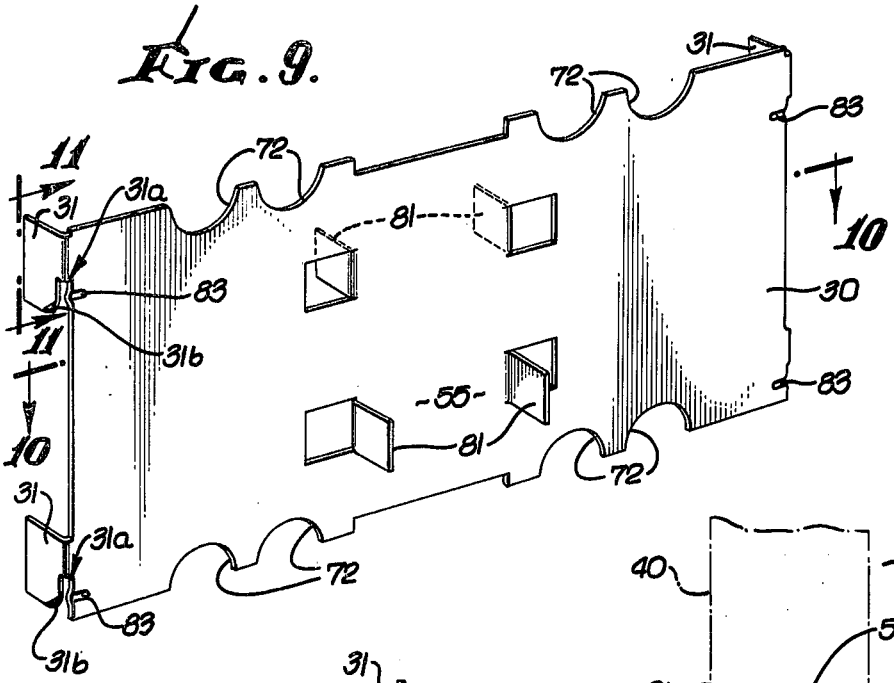
FIG. 9 is a perspective view of yet another transverse tie member having formed thereon a structural arrangement for holding the side edges of two single insulating panels.
Figure 10:
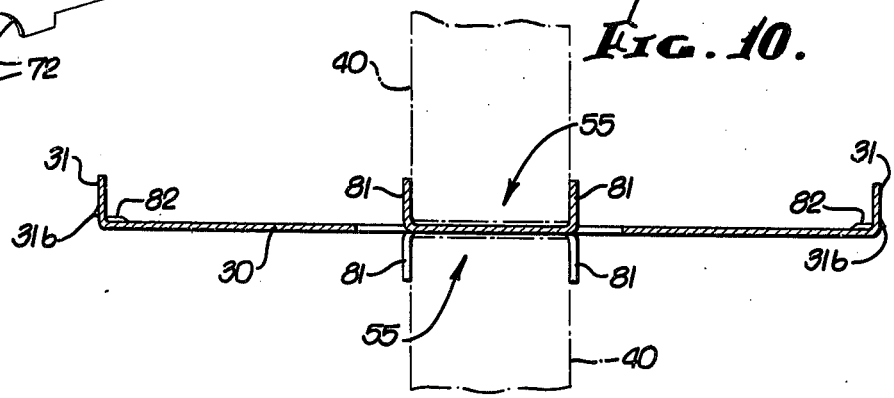
FIG. 10 is a view taken along the line 10—10 of FIG. 9.

Illustrated in FIGS. 9 and 10 is a tie member 30 arranged to commonly hold two single insulating panels extending therefrom in opposite directions. Single grooves 55 are defined on opposite sides of the tie member 30 facing away from each other. Each groove 55 is defined by a pair of spaced apart mutually parallel extensions 81 which are preferably integral parts of the tie member 30. The pairs of extensions 81 extend substantially perpendicular to the planar surface of the tie member 30 and may be conveniently formed by cutting and bending portions of the tie member 30 perpendicular to its planar surface.

Two insulating panels 40 are shown in phantom lines in FIG. 10 held by the extensions 81 in substantially vertical planes extending away from each other in diametrically opposite directions. It is noted that the pairs of extensions 81 shown formed on the tie member 30 in FIGS. 9 and 10 are positioned symmetrically about the vertical centerline of the tie member 30 to hold the insulating panels 40 in alignment midway between the tie member's ends. The pair of extensions 81 on one or both sides of the tie member 30 could, however, be offset to one side of its vertical centerline for mounting a single insulating panel closer to one or the other of the assembly side plates 11. Further, an additional set of extensions 81 could be formed on one or both of the sides of the tie member 30 offset from its vertical centerline so that an insulating panel 40 may be mounted to extend in alignment with the tie member's vertical centerline or alternately may be mounted in a position offset therefrom.

Figure 11:
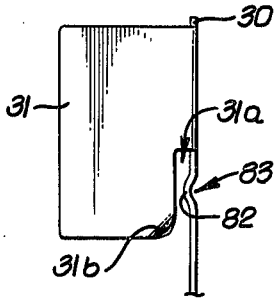
FIG. 11 is a view taken along the line 11—11 of FIG. 9.

The tie member 30 shown in FIGS. 9 and 10 has lugs 31 formed on its corners. One of these lugs 31 is shown in an enlarged scale in FIG. 11. Slots **31*a* of the type shown in FIG. 8 are formed in the lugs 31 for connecting the transverse tie member 30 to the side plate 11**.

Mechanism for snap locking the lug 31 in the slot 32 of the assembly side plate 11 is associated with each lug 31. The locking mechanism is made up of an outwardly flared or bent inner lower corner lug portion **31*b* and a projection 82 formed on the side of the tie member 30 adjacent the slot 31*a* to extend towards the lug 31. The projection 82 may be formed by indenting the other side of the tie member 30 to form a dimple 83 therein. The lug 31 is made of resilient yet substantially rigid material and the bent corner 31*b* operates when inserted into one of the slots 32 to bend towards the planar surface of the lug 31 to permit the easy insertion of the lug 31 therein. The bent corner 31*b* resists removal of the inserted lug 31 from the slot 32 by being bent outwardly to restrict the movement of the lug 31 therethrough whenever forces attempt to disengage the lug 31 from the slot 32**.

The slotted lugs 31 once inserted in slots 32 are pulled downwardly relative to the side plates 11 so that the side plate end flanges 15 are inserted into the lug slots **31*a*. The projections 82 operate to lock the end flanges 15 in this inserted position in the lug slots 31*a* by bearing against the end flanges 15 to restrict movement between the flanges 15 and the tie member 30. Thereby, the projections 82 cooperate with the bent lug corners 31*b* to lock the tie members 30 and the side plates 11** together.

Figure 12:
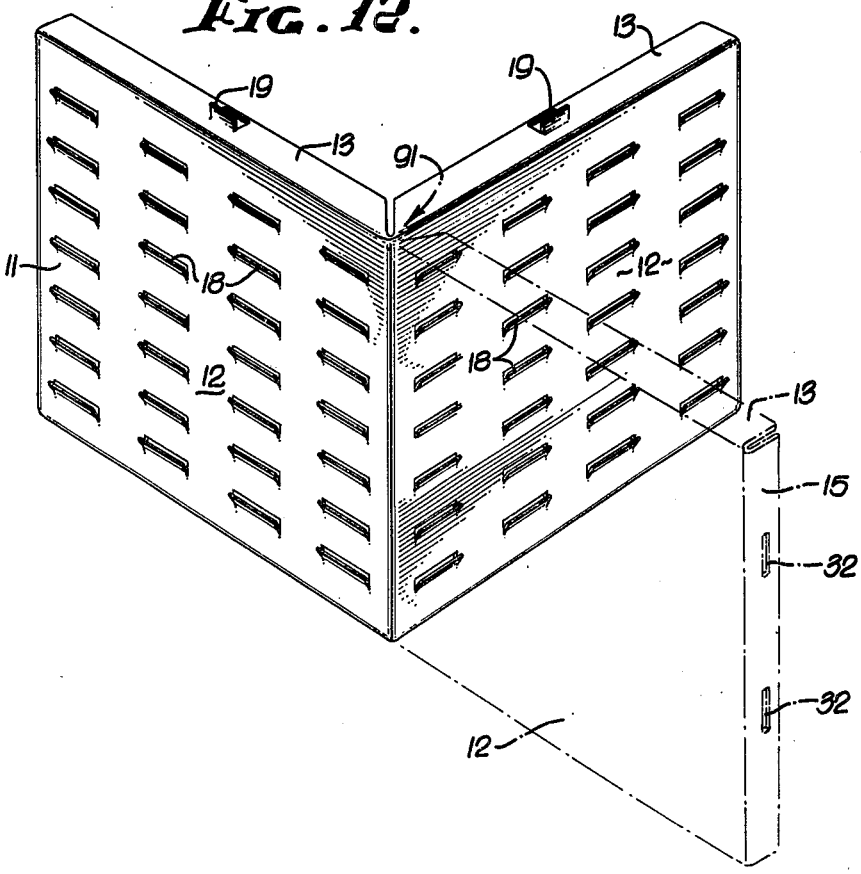
FIG. 12 is a perspective view of another embodiment of side plate arranged for bending to form a corner.

FIG. 12 illustrates an assembly side plate 11 arranged to form a corner, particularly an outside corner. A V-shaped opening 91 is cut in the top and bottom flanges 13 and 14 in vertical alignment with each other. With the side plate 11 straight or unbent, as shown in phantom in FIG. 12, the V-shaped openings 91 form angles of approximately 90°. Thereby, the side plate 11 may be bent to the position shown in FIG. 12 in solid lines to form a right angled corner. It is noted that the V-shaped openings 91 are illustrated located midway between the end flanges 15. It is also noted that for the construction of any specific wall structure the V-shaped openings 91 could be dimensioned to define angles of any preselected number of degrees and could be located at any selected location along the length of the side plates 11.

Figure 13:
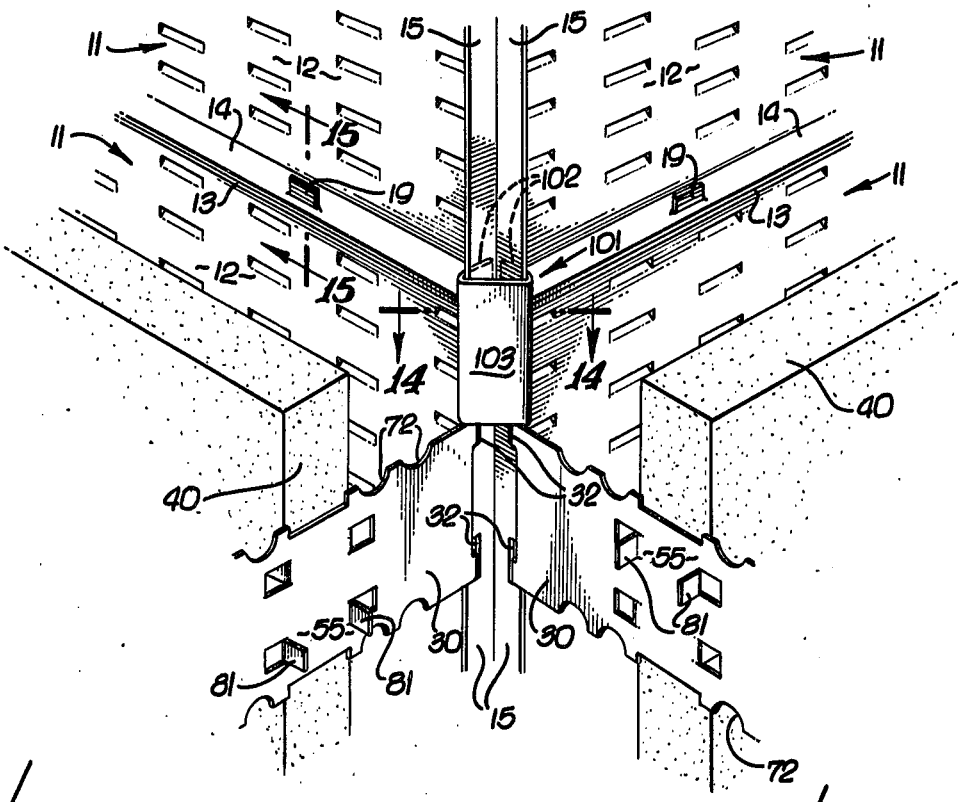
FIG. 13 is a perspective view illustrating a clip mechanism according to the present invention positioned to hold vertically and horizontally adjacent wall forming assemblies together to form an inside wall corner.

FIG. 13 illustrates the formation of the inside corner of a wall structure by interconnecting together two sets of vertically interlocked side plates 11 by means of a corner clip member 101. Transverse tie members 30 of the type shown in FIG. 9 and 10 are illustrated interlocked in the slots 32 of the lower side plates 11. Single insulating panels 40 are held spaced apart from and parallel to their associated side plates 11 by the grooves 55 defined by the extensions 81 on the tie members 30.

Figure 14:
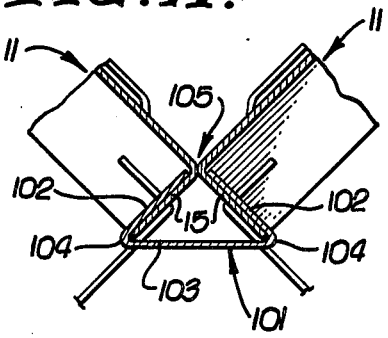
FIG. 14 is a view taken along the line 14—14 of FIG. 13.

The corner holding clip member 101 is preferably made of metal and is made up of two planar portions 102 interconnected by a planar back portion 103. As shown in FIG. 14, the portions 102 and 103 define a triangular body of a predetermined length having two closed corners 104 and an open corner 105. The angle made between the planes of the portions 102 at the open corner 105 determines the angle of the inside corner formed and in FIGS. 13–14 the portions 102 are shown extending substantially at right angles with respect to each other.

The slot type opening defined at the corner 105 by the adjacent edges of the portions 102 is dimensioned to receive the end flanges 15 of two side plates 11 and the width of the portions 102 substantially equals the width of the flanges 15. An inside corner having an angle equal to the angle between the inside surfaces of the clip portions 102, i.e. equal to 90°, is formed by slidably engaging the clip 101 with the adjacent end flanges 15 of two side plates 11. The end flanges 15 are held by each other and the back clip portion 103 flush against the clip portions 102 as shown in FIG. 14.

As shown in FIG. 13, the lower edge of the clip 101 is supported at its corners 104 by the tie members 30. The clip 101 is dimensioned to have a length greater than the distance from the position of the tie members 30 to top flanges 13 so that the clip 101 extends above the top flanges 13 on the lower side plates 11 to engage the end flanges 15 of the uppermost side plates 11 shown in FIG. 13. Thereby, the clip 103 operates to join, hold and vertically align four side plates 11 together to form an inside corner. It is noted that the outside corner of the structure shown in FIG. 13 could be formed by using an appropriately dimensioned side plate 11 of the type shown in FIG. 12.

Figure 15:
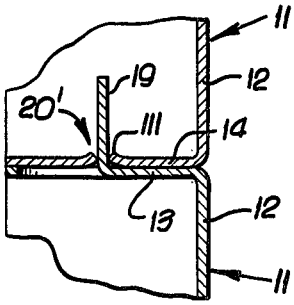
FIG. 15 is a view taken along the line 15—15 of FIG. 13 which illustrates one suitable lug-slot arrangement for interlocking vertically adjacent side plates.

FIG. 15 illustrates a slot 20' punched or pushed out in the side plate bottom flange 14 for gripping the lug 19 inserted therein. The slot 20' has its side edges 111 pushed upwardly so as to permit insertion of the lug 19 therein but to resist withdrawal of the lug 19 therefrom. Thereby, the slot 20' in combination with the lug 19 functions to interlock vertically adjacent side plates 11 together.

Figure 16:
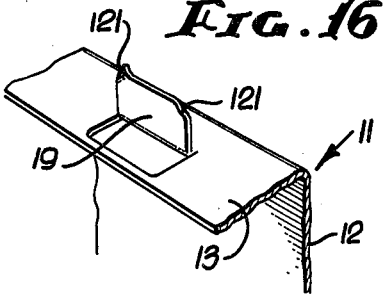
FIG. 16 is a perspective view of the lug of another suitable interlocking lug-slot arrangement.

FIG. 16 illustrats a lug 19 formed on the side plate top flange 13 which has its upper or outer corners 121 bent or flared away from each other. Thus lug 19 with the bent corners 121 forms a snap locking device which mates in an interlocking relationship with one of the earlier described slots 20. One of these slots 20 is shown in FIG. 2 formed in the bottom flange 14 of one of the side plates 11. The lug 19 shown in FIG. 16 is made of resilient yet substantially rigid material and the bent corners 121 resist the removal of the lug 19 from the slot 20 once it is inserted therein.

It is noted that the lug 19 may also be made by forming slots therein similar to the slots **31*a* formed in the lugs 31. Inner lug corners would be then defined adjacent the flange 13. These inner corners could be bent and when bent would function like the lug corners 31*b* to prevent removal of an inserted lug 19 from a slot 20**.

FIG. 17 illustrates a lug 19 formed on the side plate top flange 13 which has a dimple or indentation 131 formed therein. The dimple 131 is preferably circularly shaped and is illustrated protruding away from the side plate planar body portion 12. The dimple 131 forms a snap locking device and is shown mated in an interlocking relationship with one of the slots 20. The dimple 131 resists the removal of the lug 19 from this slot 20 once it is inserted therein. It is noted that the dimple 131 is preferably formed on the lug 19 a distance above the flange 13 just slightly greater than the thickness of the bottom flange 14 so as to prevent excessive up and down movement between the top and bottom flanges 13 and 14.

FIG. 18 illustrates a tie member 30 like the tie member shown in FIG. 9 with two differences. One difference is that the lugs 31 formed on the tie member corners have louver-shaped projections 132 formed thereon instead of bent corners. The louver-shaped projections 132 preferably are punched centrally in the planar surfaces of the lugs 31, are semi-circularly shaped, and extend inwardly. The louver-shaped projections 132 provide mechanism to snap lock the lugs 31 in the lots 32 of the side plates 11. As shown in FIG. 19, the locking edge 133 of the projections 132 extends parallel to the major planar surface of the tie member 30 and is closely spaced apart therefrom. Thereby, the end flange 15 of a side plate 11 just fits between the locking edge 133 and the major planar surface of the tie member 30.

The other difference between the tie members 30 shown in FIGS. 9 and 18 is that the tie member of FIG. 18 includes end extensions 134. The extensions 134 are planar extensions of the major planar surface of the tie member 30. The planar extensions 134 function when the tie member 30 is connected in situ to the side plates 11, as shown in FIGS. 1 and 3, as guide structure to hold the side plate end flanges 15 in vertical alignment. The extensions 134 are preferably dimensioned so that their inner edges 135 extend to a position flush with the outer side of the side plate planar surfaces 12.

Although we have herein shown and described our invention in what we have conceived to be the most practical and preferred embodiments, it is recognized that departures may be made therefrom within the scope of our invention.

We claim:

1. A prefabricated assembly for forming a concrete wall structure, comprising:

a pair of side plates for defining the outside vertically extending surfaces of said wall structure, each of said side plates having first and second horizontally spaced apart ends;

first and second tie means for interconnecting, respectively, the first ends of said side plates and the second ends of said side plates, said tie means being operable when interconnected with the ends of said side plates to hold said side plates in a spaced apart substantially parallel relationship with respect to each other, each of said tie means including a rigid transverse members which extends between the adjacent ends of said side plates;

a pair of insulating panels having first and second vertically extending side edges, said panels being dimensioned for positioning between said side plates in a parallel disposition thereto to extend from said first to said second tie means with their first vertically extending side edges positioned adjacent said first tie means and their second vertically extending side edges positioned adjacent said second tie means; and structure associated with each of said tie means for holding said insulating panels spaced apart between said side plates substantially parallel thereto, said structure defining on each of said tie means a pair of vertically extending spaced apart parallel grooves positioned for receiving and holding the vertically extending side edges of said insulating panels, said structure defining each pair of said spaced apart parallel grooves including a detachable clip which may be detachably secured to the one of said transverse members with which it is associated and also including cooperating guide structure formed on said clips and transverse members for holding said clips in predetermined aligned positions on said transverse members whereat said grooves are positioned substantially parallel with said side plates.

2. The invention defined in claim 1, including means for interlocking assembled ones of said prefabricated assemblies.

3. The invention definded in claim 1, including:

bracing ribs formed on said side plates to add structural support thereto; and outwardly projecting louvered slot arrangements formed in said side plates which function to anchor finishing materials applied to the exterior surfaces of said side plates.

4. The invention defined in claim 1, wherein said rigid transverse members have cutouts defined therein for holding steel reinforcing rods, conduits and the like.

5. The invention defined in claim 4, wherein said cutouts are laterally positioned between said side plates and the adjacent ones of said panels so that a strong concrete wall structure having an air space between said panels may be formed by pouring concrete around steel reinforcing rods held between said panels and side plates.

6. The invention definded in claim 1, wherein said structure defining each pair of said spaced apart grooves also includes extensions formed integral with said transverse members which cooperate with said clips to define said parallel grooves.

* * * * *